US010688513B2

(12) United States Patent
Biyani

(10) Patent No.: US 10,688,513 B2
(45) Date of Patent: Jun. 23, 2020

(54) PUMP-TYPE LIQUID DISPENSER

(71) Applicant: Ashok Biyani, Sylvania, OH (US)

(72) Inventor: Ashok Biyani, Sylvania, OH (US)

( * ) Notice: Subject to any disclaimer, the term of this patent is extended or adjusted under 35 U.S.C. 154(b) by 0 days.

(21) Appl. No.: 16/444,258

(22) Filed: Jun. 18, 2019

(65) Prior Publication Data

US 2019/0388921 A1 Dec. 26, 2019

Related U.S. Application Data

(60) Provisional application No. 62/687,837, filed on Jun. 21, 2018.

(51) Int. Cl.
*B05B 11/00* (2006.01)
*B05B 15/30* (2018.01)

(52) U.S. Cl.
CPC ..... *B05B 11/3043* (2013.01); *B05B 11/0037* (2013.01); *B05B 15/30* (2018.02)

(58) Field of Classification Search
CPC ..... B05B 11/3043; B05B 11/0037; B05B 11/0078; B05B 15/30; B05B 11/30; B05B 11/04; B05B 11/0086
USPC ... 222/331, 321.7, 321.9, 192, 94, 143, 131, 222/278, 288, 289; 220/527, 528, 212, 220/740; 215/288
See application file for complete search history.

(56) References Cited

U.S. PATENT DOCUMENTS

| | | | | |
|---|---|---|---|---|
| 3,402,844 | A * | 9/1968 | Chin | A47G 23/0241 215/393 |
| 5,244,106 | A * | 9/1993 | Takacs | B65D 23/12 215/12.1 |
| D799,335 | S | 10/2017 | Dimond | |
| 10,189,040 | B2 | 1/2019 | Vecchione | |
| D871,922 | S * | 1/2020 | El Beaini | D9/741 |
| 2002/0074367 | A1 | 6/2002 | Kawakita | |
| 2005/0045632 | A1* | 3/2005 | Lopez | B65D 1/06 220/212 |
| 2006/0102654 | A1* | 5/2006 | Seys | B05B 11/0005 222/94 |
| 2009/0001043 | A1* | 1/2009 | Benetti | A47G 19/2255 215/377 |
| 2009/0223999 | A1* | 9/2009 | Hill | B65D 1/04 222/129 |
| 2011/0240678 | A1 | 10/2011 | Keller et al. | |
| 2013/0098944 | A1 | 4/2013 | Broadney | |

(Continued)

*Primary Examiner* — Lien M Ngo
(74) *Attorney, Agent, or Firm* — MacMillan, Sobanski & Todd, LLC

(57) ABSTRACT

A liquid dispenser is provided. The liquid dispenser includes a reservoir portion having a first circumferential sidewall, a first partition and an opposing second partition. The first circumferential sidewall and first and second partitions define an interior chamber. A dispenser portion extends from the first partition and has a neck defined by a second circumferential sidewall. The second circumferential sidewall defines a first internal passage. A bottom portion extends from the second partition and has a third circumferential sidewall. The third circumferential sidewall and the second partition define an internal cavity. A base assembly has a pivotable lid and is configured for a first, seated orientation within the internal cavity of the bottom portion and a second, seated orientation on the first partition. In the second orientation, the pivotable lid allows fluid access to the first internal passage of the dispenser portion.

16 Claims, 12 Drawing Sheets

(56) References Cited

U.S. PATENT DOCUMENTS

| | | | | |
|---|---|---|---|---|
| 2013/0134161 | A1* | 5/2013 | Fogel | B65D 21/0209 220/23.83 |
| 2013/0284764 | A1 | 10/2013 | Baxter-Waller | |
| 2014/0008395 | A1 | 1/2014 | Syed et al. | |

* cited by examiner

PUMP-TYPE LIQUID DISPENSER

CROSS-REFERENCE TO RELATED APPLICATIONS

This application claims the benefit of U.S. Provisional Application No. 62/687,837, filed Jun. 21, 2018, the disclosure of which is incorporated herein by reference in its entirety.

BACKGROUND

Conventional dispensers are configured to release a specific amount of a material or fluid upon activation by a user. Non-limiting examples of materials or fluids include lotions, creams, shampoos, hair conditioners and the like. Dispensers, such as for example a manually activated pump-type, are typically constructed of two separate basic components, a pump head provided with a dip tube and a reservoir having a neck portion at its top. After the reservoir is provided a supply of material or fluid, the pump head is attached to the neck and the dip tube extends into the material or fluid. The user the manually activates the pump head to dispense the material or liquid in the reservoir.

The volume of the materials or fluids in the reservoir will lessen regular dispensing. Eventually the volume of the material or fluid in the reservoir decreases to a level that is not accessible by the dip tube, thereby leading to waste.

Accordingly, it is desirable to improve dispensers in a manner to minimize the inaccessible materials or fluids remaining in a reservoir.

SUMMARY

It should be appreciated that this Summary is provided to introduce a selection of concepts in a simplified form, the concepts being further described below in the Detailed Description. This Summary is not intended to identify key features or essential features of this disclosure, not is it intended to limit the scope of the pump-type liquid dispenser.

The above objects as well as other objects not specifically enumerated are achieved by a liquid dispenser. The liquid dispenser includes a reservoir portion having a first circumferential sidewall, a first partition and an opposing second partition. The first circumferential sidewall and first and second partitions define an interior chamber. The interior chamber is configured to store liquids. A dispenser portion extends from the first partition and has a neck defined by a second circumferential sidewall. The second circumferential sidewall further defines a first internal passage. The first internal passage is in fluid communication with the interior chamber. A bottom portion extends from the second partition and has a third circumferential sidewall. The third circumferential sidewall and the second partition define an internal cavity. A base assembly has a pivotable lid. The pivotable lid is configured for a first, seated orientation within the internal cavity of the bottom portion and a second, seated orientation on the first partition. In the second orientation, the pivotable lid allows fluid access to the first internal passage of the dispenser portion.

The above objects as well as other objects not specifically enumerated are also achieved by a method of using a liquid dispenser. The method includes the steps of forming a reservoir portion with a first circumferential sidewall, a first partition and an opposing second partition, the first circumferential sidewall and first and second partitions defining an interior chamber, the interior chamber configured to store liquids, forming a dispenser portion with a second circumferential sidewall extending from the first partition, the a second circumferential sidewall further defining a neck and a first internal passage, the first internal passage in fluid communication with the interior chamber, extending a bottom portion extending from the second partition, the bottom portion having a third circumferential sidewall, the third circumferential sidewall and the second partition defining an internal cavity and equipping a base assembly with a pivotable lid, the base assembly configured for a first, seated orientation within the internal cavity of the bottom portion and also configured for a second, seated orientation on the first partition. In the second orientation, the pivotable lid allows fluid access to the first internal passage of the dispenser portion.

Various aspects and advantages of the pump-type liquid dispenser will become apparent to those skilled in the art from the following detailed description, when read in light of the accompanying drawings.

DETAILED DESCRIPTION

The pump-type liquid dispenser will now be described with occasional reference to specific embodiments. The pump-type liquid dispenser may, however, be embodied in different forms and should not be construed as limited to the embodiments set forth herein. Rather, these embodiments are provided so that this disclosure will be thorough and complete, and will fully convey the scope of the pump-type liquid dispenser to those skilled in the art.

Unless otherwise defined, all technical and scientific terms used herein have the same meaning as commonly understood by one of ordinary skill in the art to which the pump-type liquid dispenser belongs. The terminology used in the description of the pump-type liquid dispenser herein is for describing particular embodiments only and is not intended to be limiting of the pump-type liquid dispenser. As used in the description of the pump-type liquid dispenser and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to he obtained in embodiments of the pump-type liquid dispenser. Notwithstanding that the numerical ranges and parameters setting forth the broad scope of the pump-type liquid dispenser are approximations, the numerical values set forth in the specific examples are reported as precisely as possible. Any numerical values, however, inherently contain certain errors necessarily resulting from error found in their respective measurements.

In accordance with illustrated embodiments, the description and figures disclose a pump-type liquid dispenser having a removable base assembly. After removal, the base assembly is seated around a neck, thereby facilitating removal of previously inaccessible fluids contained in a reservoir portion. The term "dispenser" as used herein, is defined to mean any structure configured to release a specific amount of a fluid.

Figure 1:
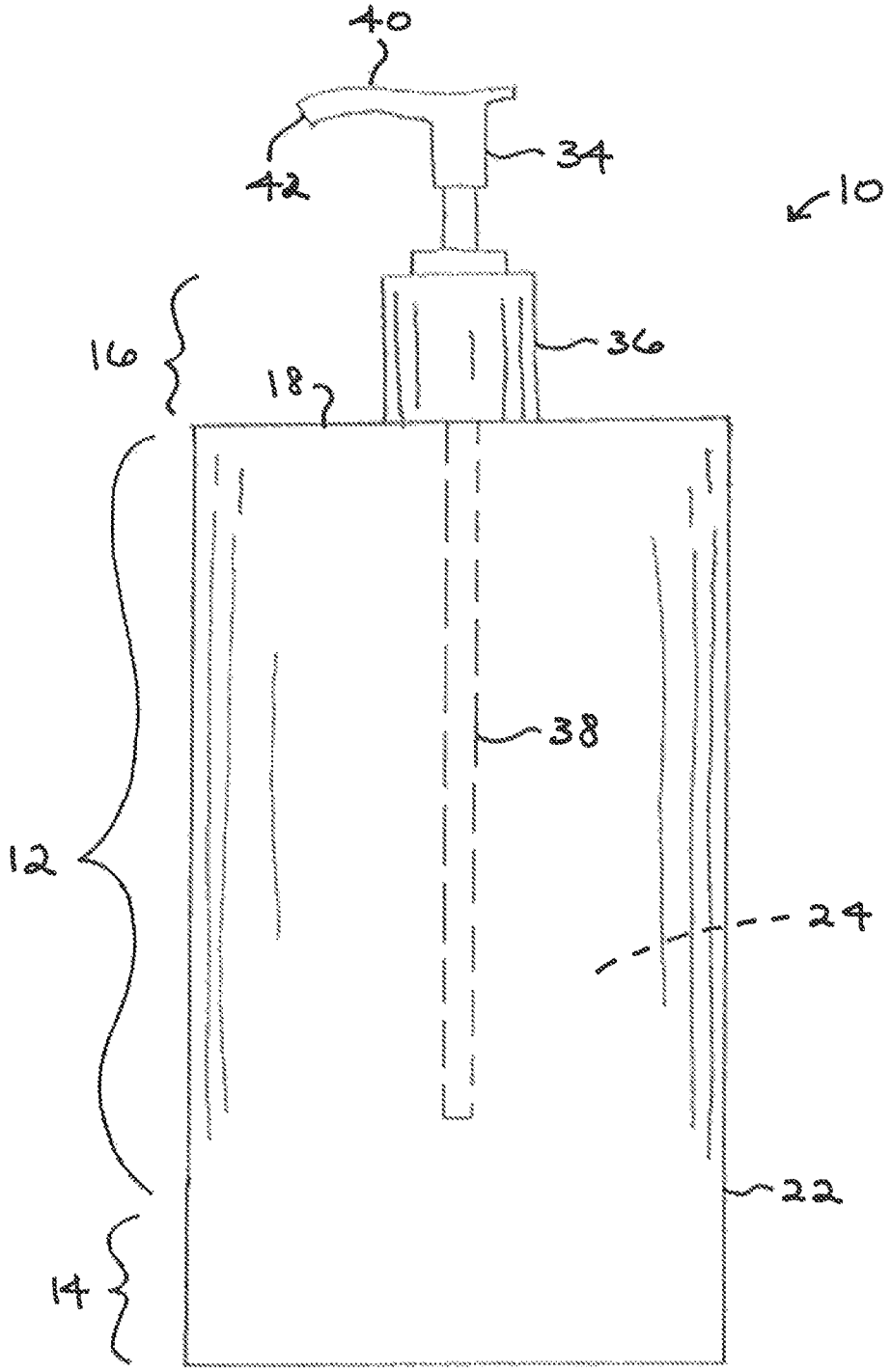
FIG. 1 is a front view, in elevation, of a pump-type liquid dispenser in accordance with this invention.
Figure 2:
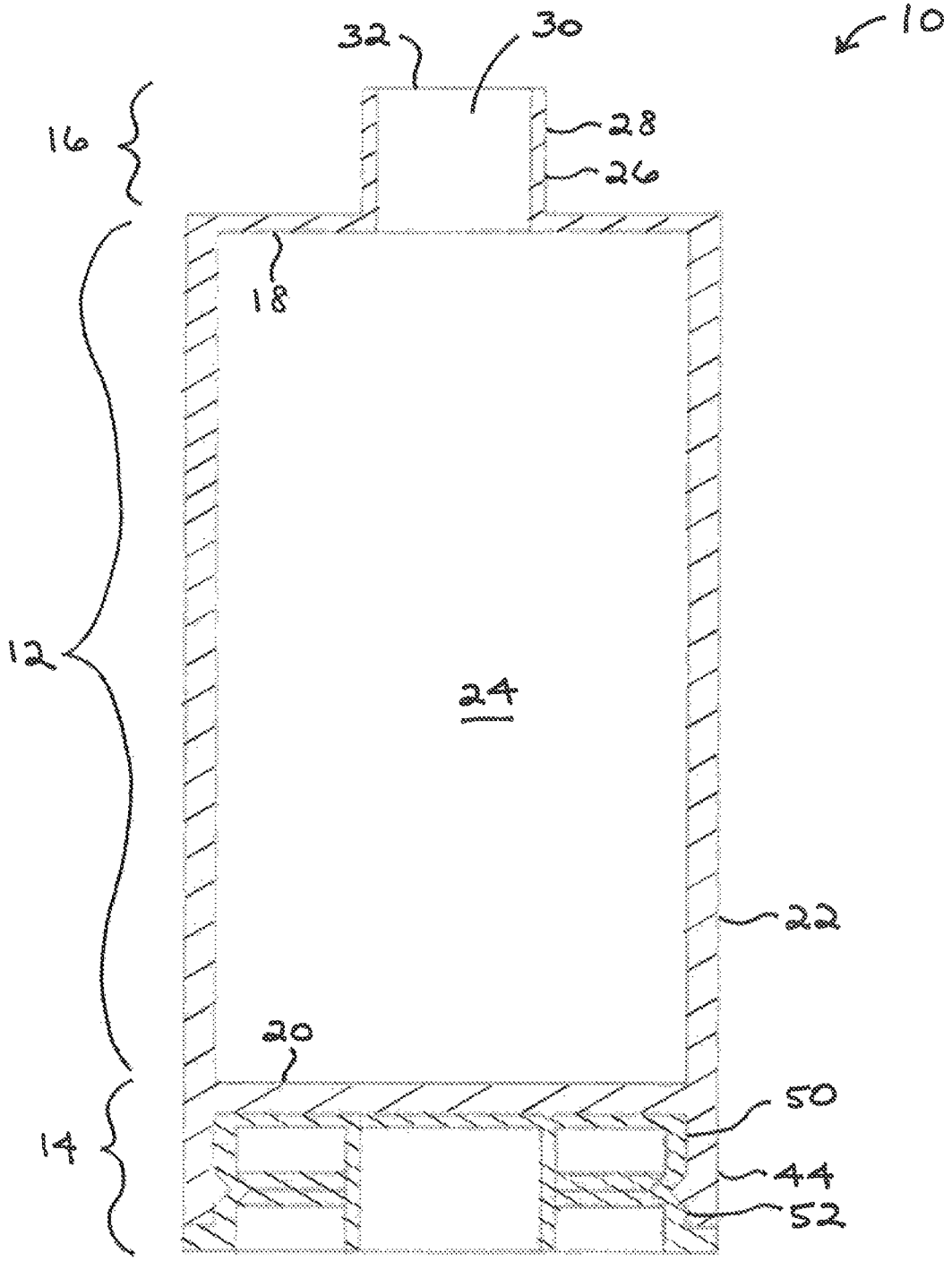
FIG. 2 is a front, cross-sectional view of portions of the pump-type liquid dispenser illustrated in FIG. 1.

Referring now to FIGS. 1 and 2, one-non-limiting embodiment of a pump-type liquid dispenser (hereafter "dispenser") is shown at 10. The dispenser 10 is configured to contain and dispense liquids such as the non-limiting examples of shampoos, lotions, creams, gels and the like. The dispenser 10 includes a reservoir portion 12, a bottom portion 14 and a dispenser portion 16. The reservoir portion 12 includes a first partition 18, an opposing second partition 20 and a first circumferential sidewall 22 extending from the first and second partitions 18, 20. The first and second partitions 18, 20 and the first circumferential sidewall 22 cooperate to define an interior chamber 24. The interior chamber 24 is configured to store the liquid to be dispensed, in the illustrated embodiment, the first circumferential sidewall 22 has a circular cross-sectional shape resulting in the reservoir portion 12 having a cylindrical shape along a longitudinal axis. However, in other embodiments, the first circumferential sidewall 22 can have other cross-sectional shapes and the reservoir portion 12 can have other longitudinal shapes. In the illustrated embodiment, the reservoir portion 12 of the dispenser 10 is formed from a flexible polymeric material, such as the non-limiting example of high-density polyethylene (HDPE), in order to permit contraction of the reservoir portion 12 and subsequent urging of liquids from the interior chamber 24. However, in other embodiments, the reservoir portion 12 of the dispenser 10 can be formed from other materials, sufficient for the functions described herein.

Referring now to FIG. 2, the dispenser portion 16 includes a neck 26 extending in an outward direction from the first partition 18. The neck 26 includes a second circumferential sidewall 28 configured to define a first internal passage 30 extending through the neck 26. The neck 26 also includes an opening 32 at an outward end. The first internal passage 30 and the opening 32 cooperated to provide fluid communication for liquids exiting the interior chamber 24 of the reservoir portion 12.

Referring again to FIG. 1, the neck 22 (not shown) of the dispenser portion 16 is configured to removably support a conventional dispensing mechanism, such as a manual-style pump 34. The pump 34 may include a cap 36, which is removably attached to the neck 22. The cap 36 may be attached to the neck 22 in any manner, such as the non-limiting examples of cooperating threads, clips, clamps, snaps and the like. The pump 34 also includes a conduit 38 that extends into the interior chamber 24. In certain instances, the pump 34 can include a pump handle 40, configured to actuate the pump 34 in order to cause liquid stored in the interior chamber 24 to travel through the conduit 38 and exit the pump 34 through a spout 42.

Figure 3:
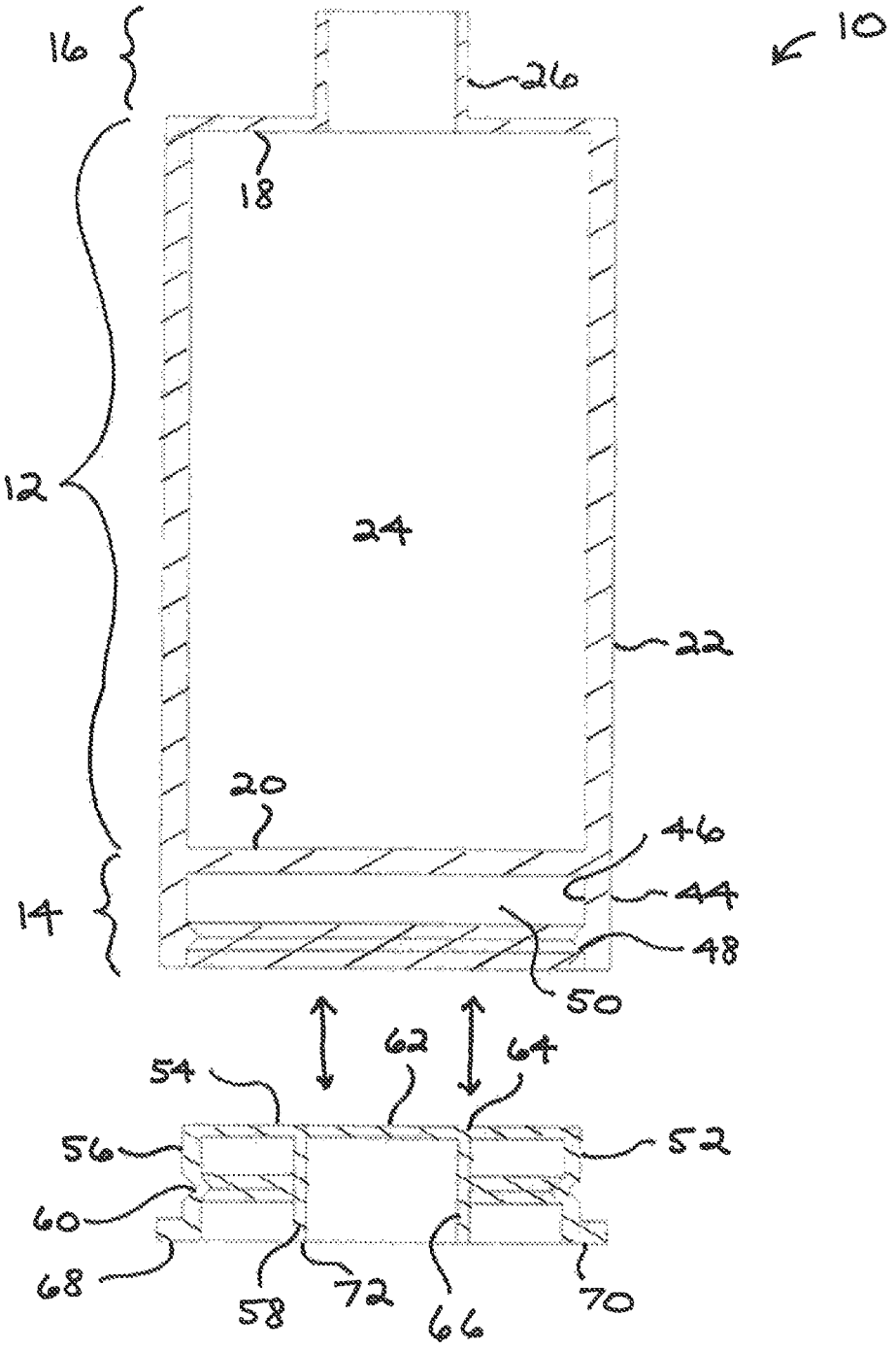
FIG. 3 is a front, cross-sectional view of portions of the pump-type liquid dispenser of FIG. 1, illustrating a base portion removed from a bottom portion.

Referring now to FIG. 3, the bottom portion 14 includes a third circumferential sidewall 44 that extends in an outward direction from and aligns with the first circumferential sidewall 22. In the illustrated embodiment, the third circumferential sidewall 44 has the same circular cross-sectional shape as the first circumferential sidewall 22. However, in other embodiments, the first and third circumferential sidewalls 22, 44 can have different cross-sectional shapes. The third circumferential sidewall 44 has an inner surface 46. An annular projection 48 extends inwardly from the inner surface 46. In the illustrated embodiment, the annular projection 34 has the cross-sectional shape of a ridge, with an apex of the ridge extending in an inward direction.

Referring again to FIGS. 2 and 3, the second partition 20 and the third circumferential sidewall 44 cooperate to form an internal cavity 50. The internal cavity 50 is configured to house a base assembly 52. As will be explained in more detail below, the base assembly 52 is configured for a first orientation, which is secured to the bottom portion 14 of the dispenser 10 within the internal cavity 50. The base assembly 52 is also configured for a second orientation, in which the base assembly 52 is removed from the bottom portion 14 of the dispenser and subsequently attached to the neck 26 of the dispenser portion 16, and seated against the first partition 18.

Referring now to FIG. 3, the base assembly 52 includes an upper segment 54 connected to a fourth circumferential sidewall 56. The upper segment 54 is also connected to a fifth circumferential sidewall 58. The fourth circumferential sidewall 56 includes an annular recess 60. The annular recess 60 has a cross-sectional shape that closely corresponds to the annular projection 48 in a manner such that the annular projection 48 seats in the annular recess 60 as the base assembly 52 seats within the internal cavity 50 of the bottom portion 14 of the dispenser 10. In the seated orientation, the upper segment 54 of the base assembly 52 seats against the second partition 20, an outer surface of the fifth circumferential sidewall 56 seats against the inner surface 46 of the third circumferential sidewall 44 and the base assembly 52 is secured to the bottom portion 14 of the dispenser 10.

Referring again to FIG. 3, the upper segment 54 of the base assembly 52 includes a pivotable lid 62. The pivotable lid 62 is configured to pivot about pivot point 64. The pivotable lid 62 will be discussed in more detail below.

Referring again to FIG. 3, an inner surface 64 of the annular fifth circumferential sidewall 58 defines a second internal passage 66. As will be discussed in more detail below, the second internal passage 66 is configured to receive the second circumferential sidewall 28 forming the neck 26.

Referring again to FIG. 3, a lower portion of the fifth circumferential sidewall 56 forms an annular lip 68. The lip 68 forms a lower surface 70. In a similar manner, a lower portion of the fifth circumferential sidewall 58 forms a lower surface 72. The lower surfaces 70, 72 of the lip 68 and the fifth circumferential sidewall 58 are coplanar.

Figure 4:
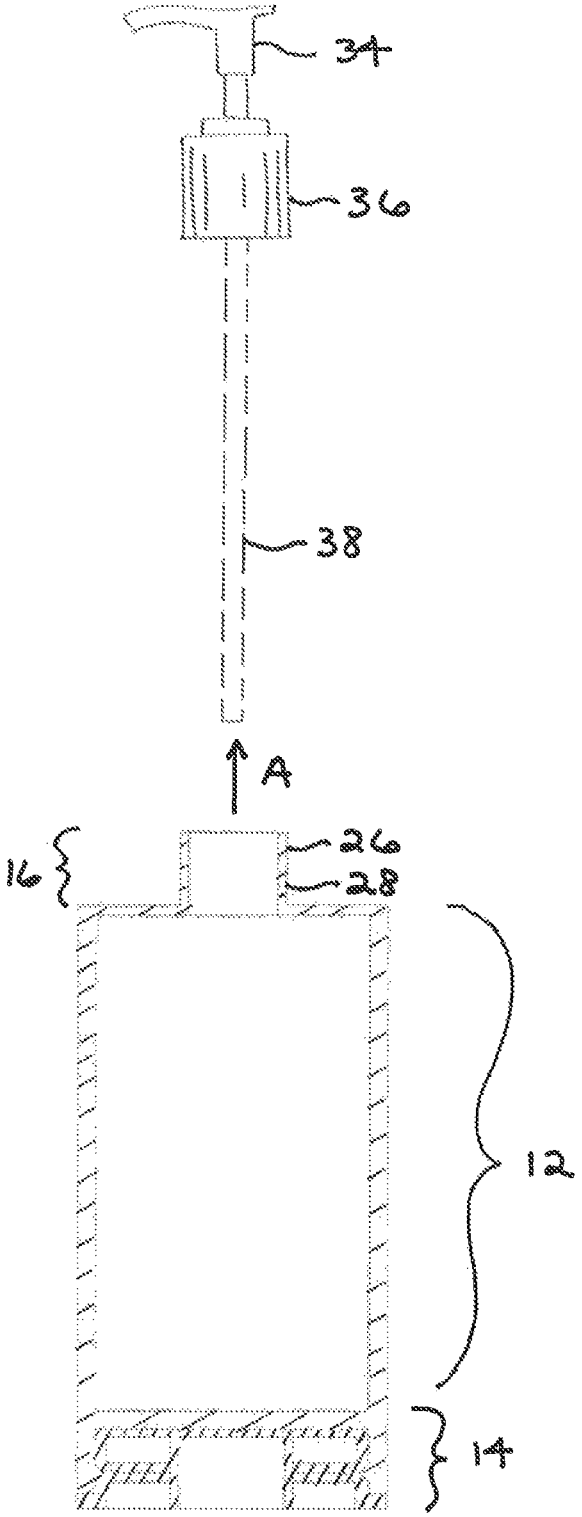
FIG. 4 is a front, cross-sectional view of portions of the pump-type liquid dispenser of FIG. 1, illustrating a pump and cap removed from a dispenser portion.

Referring now to FIGS. 1 and 2, the base assembly 52 is illustrated in the first orientation, which is, secured to the bottom portion 14 of the dispenser 10 within the internal cavity 50. During use of the dispenser 10, the level of the liquid contained within the interior chamber 24 of the reservoir portion 12 will decrease to a level that is not accessible by a lower end of the conduit 38. Accordingly, the remaining portions of the liquid will normally be inaccessible for use. To make use of the remaining portions of the liquid, a user may convert the dispenser 10 from a pump-type dispenser to a squeeze-type dispenser according to the following steps. Referring now to FIG. 4 in a first step, the pump 34 and cap 36 are disconnected from the second circumferential sidewall 28 of the neck 26, as schematically shown by direction arrow A. Removal of the pump 34 and cap 36 results in removal of the conduit 38.

Figure 5:
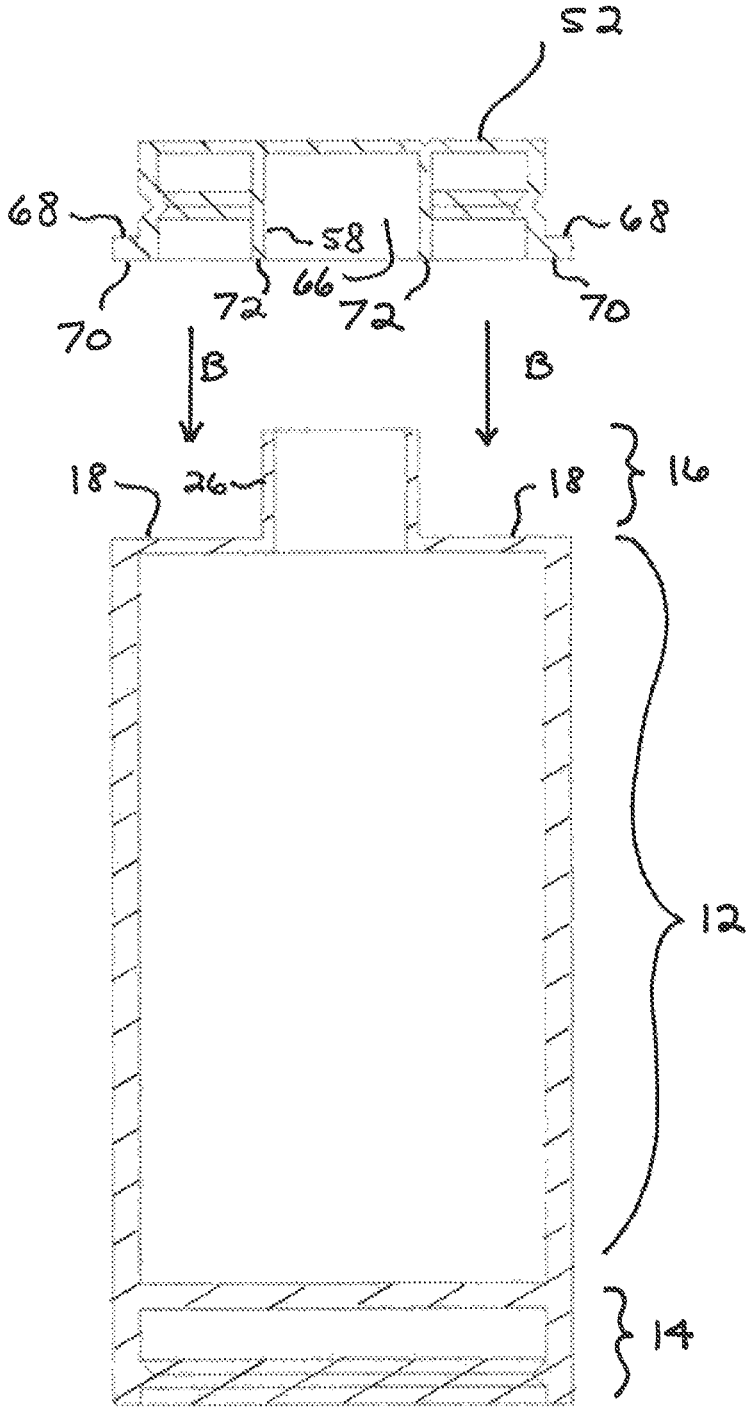
FIG. 5 is a front, cross-sectional view of portions of the pump-type liquid dispenser of FIG. 1, illustrating the positioning of the bottom portion adjacent a neck.

Referring now to FIG. 3 in a next step, the base assembly 52 is removed from the bottom portion 14 of the dispenser 10 by disengagement of the annular recess 60 of the base assembly 52 from the annular projection 48 of the bottom portion 14. Referring now to FIG. 5 in a next step, the base assembly 52 is positioned above the neck 26 of the dispenser portion 26. In this position, the lower surfaces 70, 72 of the annular lip 68 and fifth circumferential sidewall 58 face an outer surface of the first partition 18. The second internal passage 66 of the base assembly 52 is axially aligned with the first internal passage 30 in the neck 26. In a next step, the base assembly 52 is moved toward the dispenser portion 16 as shown by direction arrows B.

Figure 6:
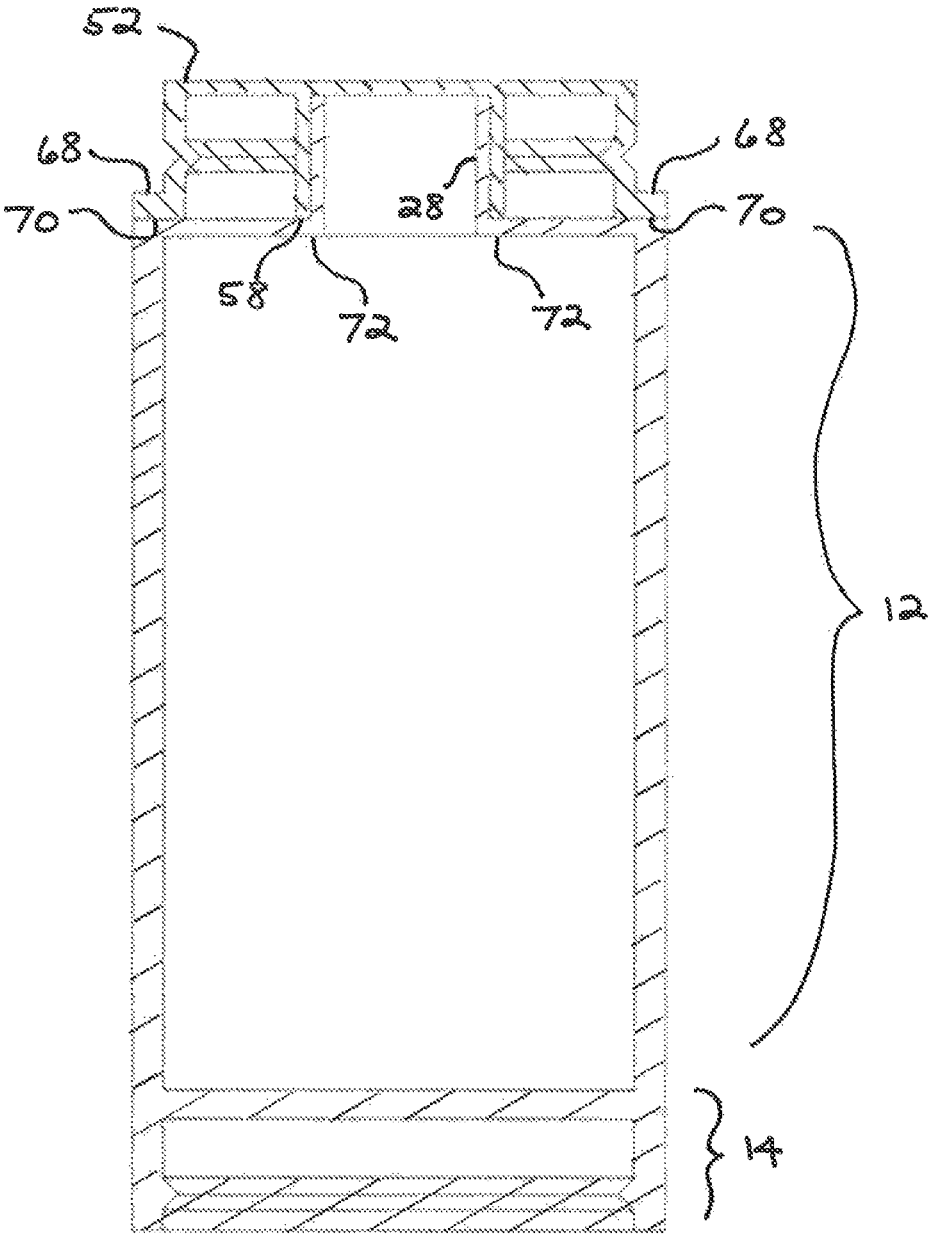
FIG. 6 is a front, cross-sectional view of portions of the pump-type liquid dispenser of FIG. 1, illustrating the seating of the bottom portion on a circumferential sidewall of the neck.

Referring now to FIG. 6, the lower surfaces 70, 72 of the annular lip 68 and fifth circumferential sidewall 58 are brought into contact with the outer surface of the first partition 18. In this position, an outer surface of the second circumferential sidewall 28 of the neck 26 forms an interference fit with the inner surface of the fifth circumferential sidewall 58 of the base assembly 52, thereby securing the base assembly 52 in place.

Figure 7:
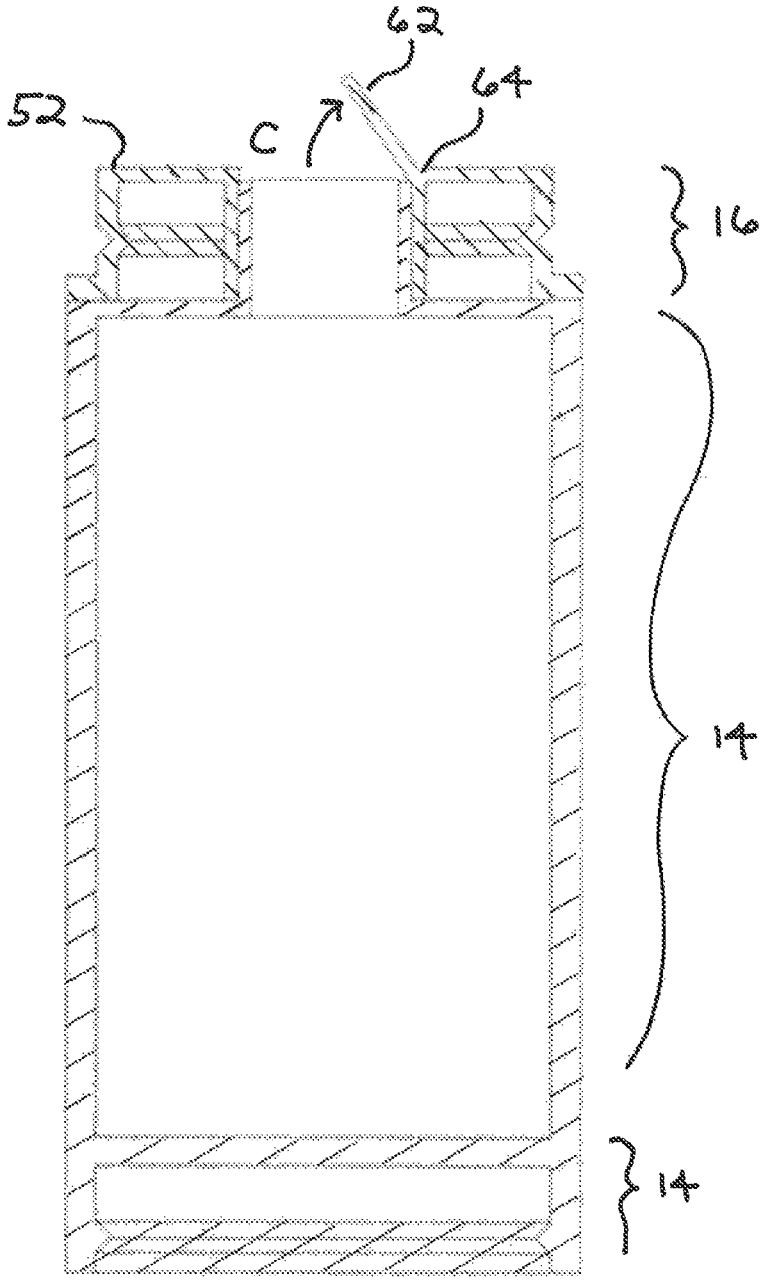
FIG. 7 is a front, cross-sectional view of portions of the pump-type liquid dispenser of FIG. 6, illustrating the pivoting of a lid from the bottom portion.

Referring now to FIG. 7, the dispenser 10 is shown with the pivotable lid 62 in an open position, that is, one end of the pivotable lid 62 is pivoted about the pivot point 64. Once the base assembly 52 is attached to the dispenser portion 16, the dispenser 10 can be inverted to access the liquid contained within the interior chamber 24 of the reservoir portion 12.

Figure 8:
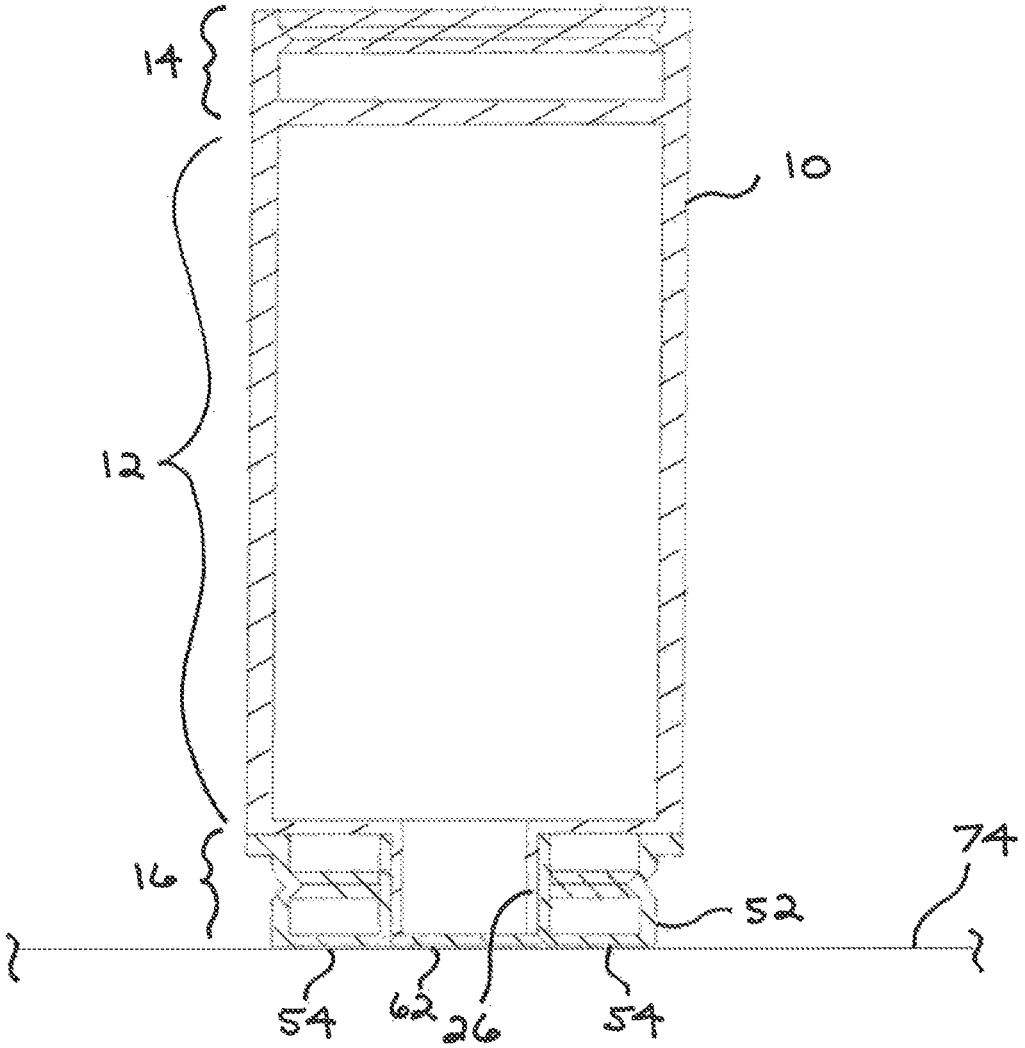
FIG. 8 is a front, cross-sectional view of portions of the pump-type liquid dispenser of FIG. 6, illustrating the storage of the dispenser with the bottom portion seated on a circumferential sidewall of the neck.

Referring now to FIG. 8, the dispenser 10 with the base assembly 52 attached to the neck 26, can be inverted into a substantially vertical orientation for storage on an external support surface 74, such as a countertop. In this position, an outer surface of the upper segment 54 of the base assembly 52 seats against the external support surface 74. It should be appreciated that the upper segments 54 of the base assembly 52 have sufficient dimensions to facilitate stable seating of the inverted dispenser 10 against the external support surface 74. Advantageously, storage of the dispenser 10 in the inverted orientation allows the liquid contained in the interior chamber 24 of the reservoir portion 12 to flow in a direction toward the pivotable lid 62, thereby facilitating access in subsequent uses of the dispenser 10.

Figure 9:
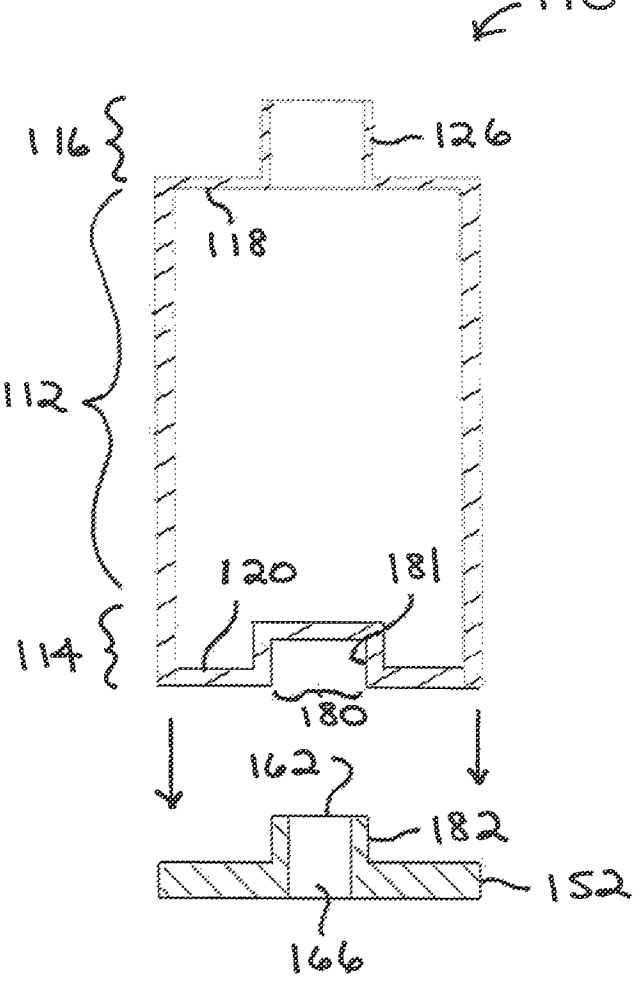
FIG. 9 is a front, cross-sectional view of portions of an alternate the pump-type liquid dispenser, illustrating a recess formed in a discontinuous second partition and a projection configured to seat within the recess.

While the embodiments shown in FIGS. 1-8 illustrate the base assembly 52 connected to the bottom portion 14 of the dispenser through use of an annular projection and an annular recess, it is contemplated that in other embodiments other structures, mechanisms and devices can be used to attach a base assembly to the bottom portion of the dispenser. FIGS. 9-14 illustrate alternate attachment concepts. Referring first to FIG. 9, a second embodiment of a dispenser is shown generally at 110. The dispenser 110 includes a reservoir portion 112, a bottom portion 114 and a dispenser portion 116. In the illustrated embodiment, the reservoir portion 112 and dispenser portion 116 are the same as, or similar to, the reservoir portion 12 and dispenser portion 16 described above and shown in FIG. 2. However, it is contemplated that in other embodiments, the reservoir portion 112 and dispenser portion 116 can be different from the reservoir portion 12 and dispenser portion 16. The bottom portion 114 includes a second partition 120. The second partition 120 includes a recess 180. The recess 180 is defined by an inner surface of an annular circumferential wall 181. The recess 180 is configured to receive a projection 182 extending from a second embodiment of a base assembly 152. The projection 182 includes an interior passage 166, formed therethrough and a pivotable lid 162. The base assembly 152 is attached to the bottom portion 114 through an interference fit between the inner surface of the annular circumferential wall 181 of the recess 180 and an outer surface of the projection 182. In use, the base assembly 152 is removed from the bottom portion 114 and attached to the neck 126 of the dispenser portion 116 as described above.

Figure 10:
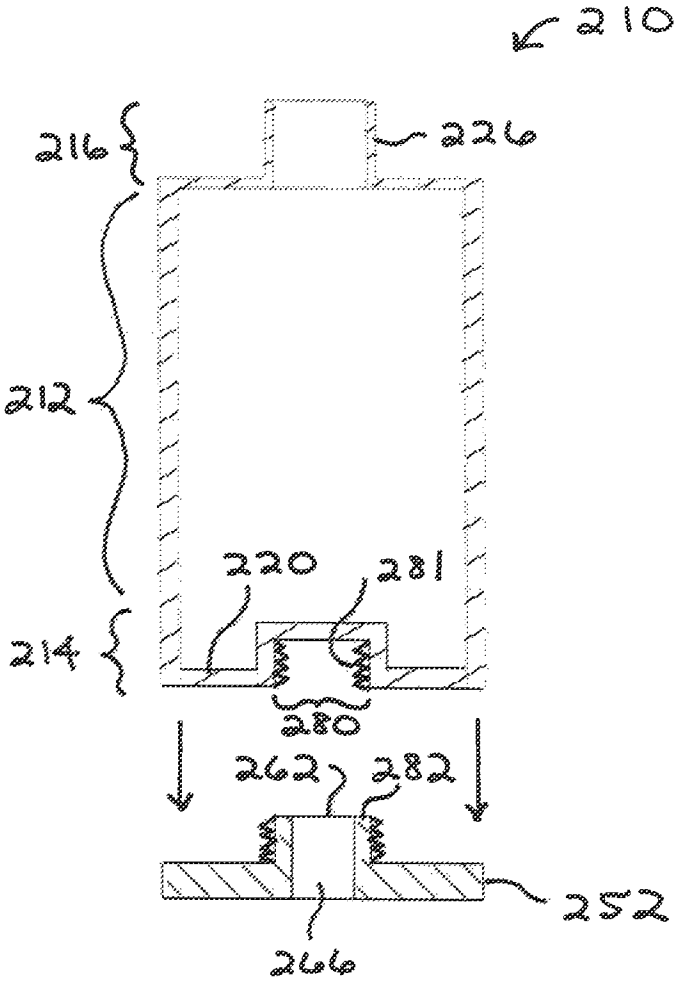
FIG. 10 is a front, cross-sectional view of portions of the dispenser of FIG. 9, illustrating a threaded connection between the recess and the projection.

Referring now to FIG. 10, another embodiment of a dispenser is shown generally at 210. The dispenser 210 includes a reservoir portion 212, a bottom portion 214, a dispenser portion 216 and a base assembly 252. In the illustrated embodiment, the reservoir portion 212 and dispenser portion 216 are the same as, or similar to, the reservoir portion 12 and dispenser portion 16 described above and shown in FIG. 2. However, it is contemplated that in other embodiments, the reservoir portion 212 and dispenser portion 216 can be different from the reservoir portion 12 and dispenser portion 16. The bottom portion 214 includes a second partition 220, the second partition 120 including a recess 280. The recess 180 is defined by an inner surface of an annular circumferential wall 281. The inner surface of an annular circumferential wall 281 is threaded. The base assembly 252 includes a projection 282 having an interior passage 266, formed therethrough and a pivotable lid 262. The projection 282 includes a threaded outer surface. The dispenser 210 illustrated in FIG. 10 is the same as, or similar to, the dispenser 110 shown in FIG. 9, with the exception that the base assembly 252 is attached to the bottom portion 214 through a threaded connection between the annular circumferential wall 281 of the recess 280 and the outer surface of the projection 282. In use, the base assembly 252 is removed from the bottom portion 214 and attached to the neck 226 of the dispenser portion 216 as described above.

Figure 11:
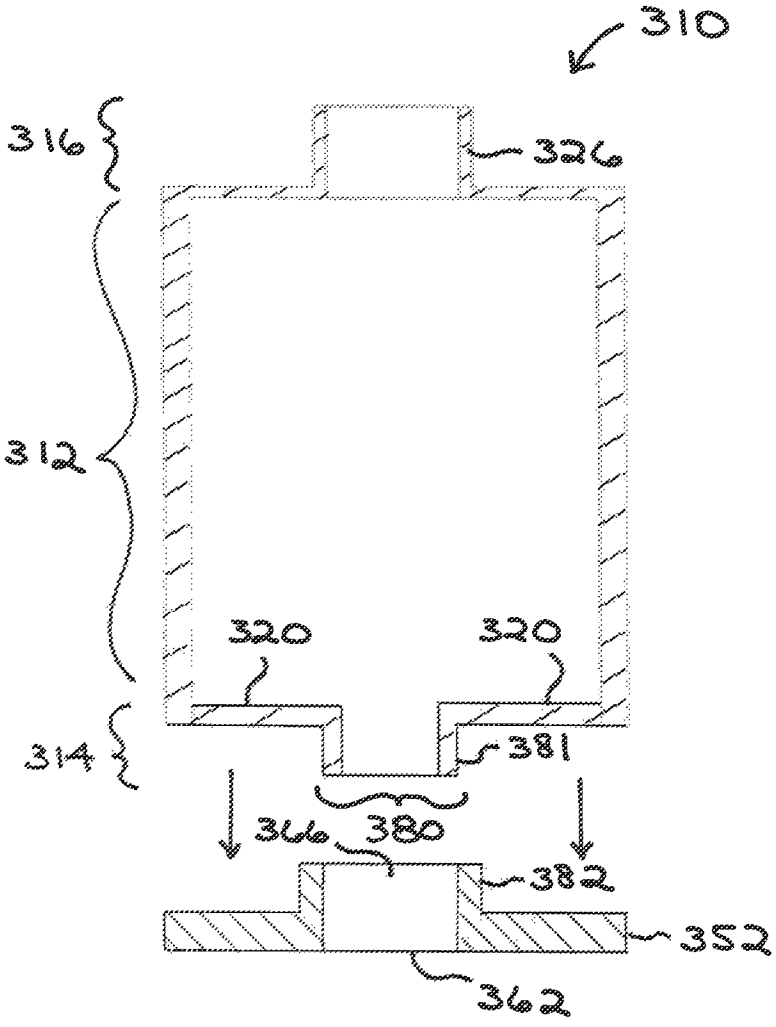
FIG. 11 is a front, cross-sectional view of portions of an alternate the pump-type liquid dispenser, illustrating a first projection formed in a discontinuous second partition and a second projection configured to seat within the first projection.

Referring now to FIG. 11, another embodiment of a dispenser is shown generally at 310. The dispenser 310 includes a reservoir portion 312, a bottom portion 314 and a dispenser portion 316. In the illustrated embodiment, the reservoir portion 312 and dispenser portion 316 are the same as, or similar to, the reservoir portion 12 and dispenser portion 16 described above and shown in FIG. 2. However, it is contemplated that in other embodiments, the reservoir portion 312 and dispenser portion 316 can be different from the reservoir portion 12 and dispenser portion 16. The bottom portion 314 includes a discontinuous second partition 320. The second partition 320 includes a projection 380. The projection 380 is defined by an outer surface of an annular circumferential wall 381. The projection 380 is configured for insertion into a recess 382 extending from another embodiment of a base assembly 352. The projection 382 includes an interior passage 366, formed therethrough and a pivotable lid 362. The base assembly 352 is attached to the bottom portion 314 through an interference fit between the outer surface of the annular circumferential wall 381 of the projection 380 and an inner surface of the projection 382. In use, the base assembly 352 is removed from the bottom portion 314 and attached to the neck 326 of the dispenser portion 316 as described above.

Figure 12:
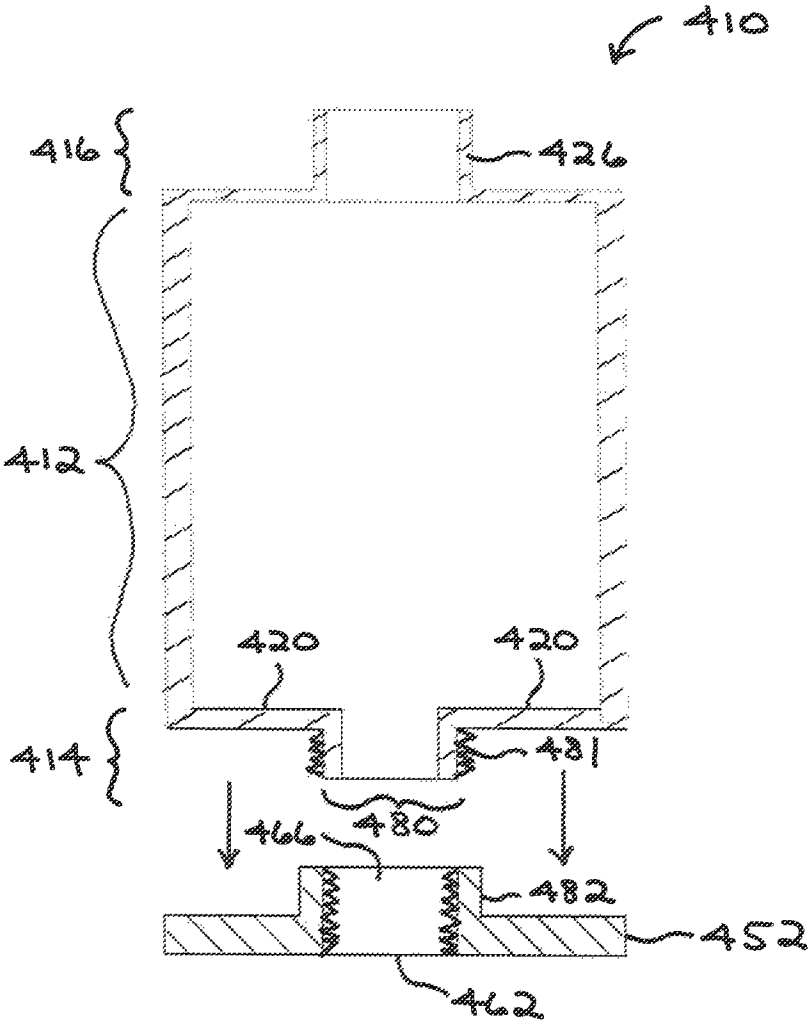
FIG. 12 is a front, cross-sectional view of portions of the dispenser of FIG. 11, illustrating a threaded connection between the first and second projections.

Referring now to FIG. 12, another embodiment of a dispenser is shown generally at 410. The dispenser 410 includes a reservoir portion 412, a bottom portion 414, a dispenser portion 416 and a base assembly 452. In the illustrated embodiment, the reservoir portion 412 and dispenser portion 416 are the same as, or similar to, the reservoir portion 12 and dispenser portion 16 described above and shown in FIG. 2, However, it is contemplated that in other embodiments, the reservoir portion 412 and dispenser portion 416 can be different from the reservoir portion 12 and dispenser portion 16. The bottom portion 414 includes a discontinuous second partition 420, the second partition 420 including a projection 480. The projection 480 is defined by an outer surface of an annular circumferential wall 481. The outer surface of an annular circumferential wall 481 is threaded. The base assembly 452 includes a projection 482 having an interior passage 466, formed therethrough and a pivotable lid 462. The projection 482 includes a threaded inner surface. The dispenser 410 illustrated in FIG. 12 is the same as, or similar to, the dispenser 310 shown in FIG. 11, with the exception that the base assembly 452 is attached to the bottom portion 414 through a threaded connection between the annular circumferential wall 481 of the projection 480 and the inner surface of the projection 482. In use, the base assembly 452 is removed from the bottom portion 414 and attached to the neck 426 of the dispenser portion 416 as described above.

Figure 13:
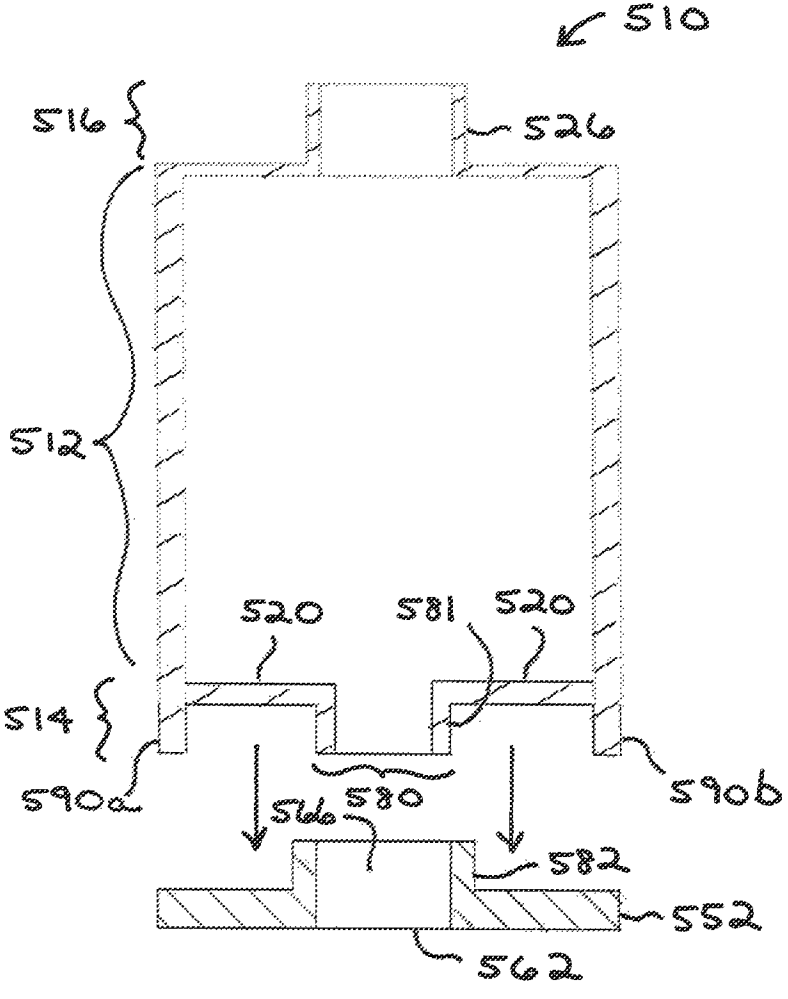
FIG. 13 is a front, cross-sectional view of portions of an alternate the pump-type liquid dispenser, illustrating a first projection formed in a discontinuous second partition, a second projection configured to seat within the first projection and a plurality of support elements extending from the discontinuous second partition.

Referring now to FIG. 13, another embodiment of a dispenser is shown generally at 510. The dispenser 510 includes a reservoir portion 512, a bottom portion 514 and a dispenser portion 516. In the illustrated embodiment, the reservoir portion 512 and dispenser portion 516 are the same as, or similar to, the reservoir portion 12 and dispenser portion 16 described above and shown in FIG. 2. However, it is contemplated that in other embodiments, the reservoir portion 512 and dispenser portion 516 can be different from the reservoir portion 12 and dispenser portion 16. The bottom portion 514 includes a discontinuous second partition 520. The second partition 520 includes a projection 580. The projection 580 is defined by an outer surface of an annular circumferential wall 581.

Referring again to FIG. 13, the bottom portion 514 includes a plurality of support elements 590*a*, 590*b*. A bottom surface of each of the support elements 590*a*, 590*b* is coplanar with a bottom surface of the projection 590. In this manner, the plurality of support elements 590*a*, 590*b* and the projection 590 advantageously can be used to support the dispenser 510 once a base assembly 552 is removed and the dispenser 510 is aligned in a substantially vertical orientation on a horizontal surface.

Referring again to FIG. 13, the projection 580 is configured for insertion into a projection 582 extending from another embodiment of a base assembly 552. The projection 582 includes an interior passage 566, formed therethrough and a pivotable lid 562. The base assembly 552 is attached to the bottom portion 514 through an interference fit between the outer surface of the annular circumferential wall 581 of the projection 580 and an inner surface of the projection 582. In use, the base assembly 552 is removed from the bottom portion 514 and attached to the neck 526 of the dispenser portion 516 as described above.

Figure 14:
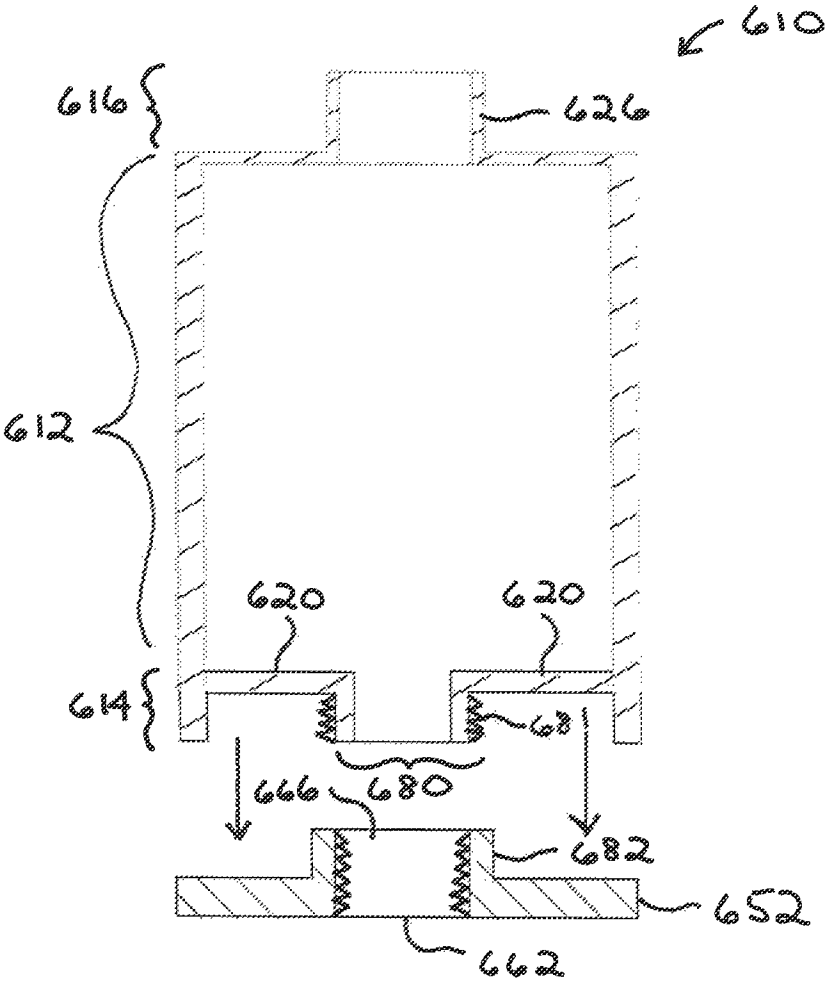
FIG. 14 is a front, cross-sectional view of portions of the dispenser of FIG. 13, illustrating a threaded connection between the first and second projections.

Referring now to FIG. 14, another embodiment of a dispenser is shown generally at 610. The dispenser 610 includes a reservoir portion 612, a bottom portion 614, a dispenser portion 616 and a base assembly 652. The bottom portion 614 includes a discontinuous second partition 620, the second partition 620 including a projection 680. The projection 680 is defined by an outer surface of an annular circumferential wall 681. The outer surface of an annular circumferential wall 681 is threaded. The base assembly 652 includes a projection 682 having an interior passage 666, formed therethrough and a pivotable lid 662. The projection 682 includes a threaded inner surface. The dispenser 610 illustrated in FIG. 14 is the same as, or similar to, the dispenser 510 shown in FIG. 13, with the exception that the base assembly 652 is attached to the bottom portion 614 through a threaded connection between the annular circumferential wall 681 of the projection 680 and the inner surface of the projection 682. In use, the base assembly 652 is removed from the bottom portion 614 and attached to the neck 626 of the dispenser portion 616 as described above.

Figure 16:
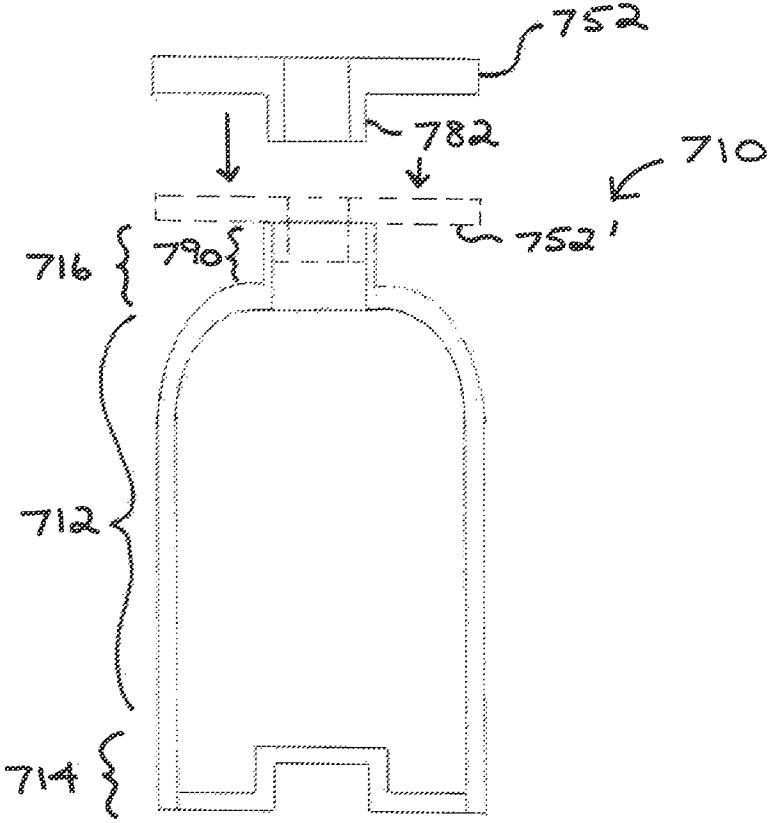
FIG. 16 is a front, cross-sectional view of the dispenser of FIG. 15, illustrating a base assembly in an installed orientation.
Figure 15:
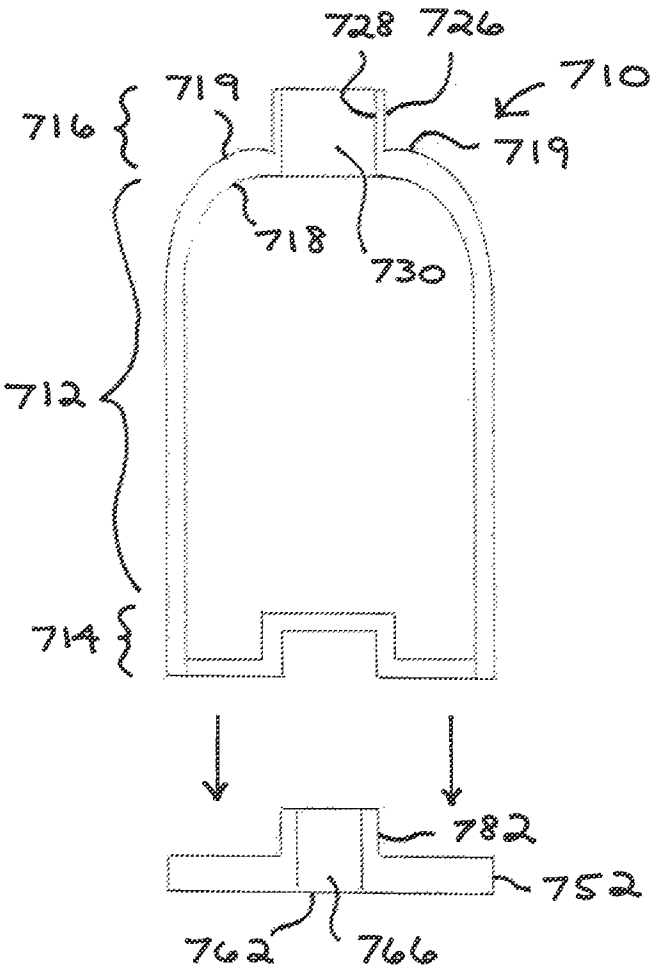
FIG. 15 is a front, cross-sectional view of portions of an alternate the pump-type liquid dispenser, illustrating a first partition formed from an annular arcuate segment extending from a neck.

Referring now to FIGS. 15 and 16, another embodiment of a dispenser is shown generally at 710. The dispenser 710 includes a reservoir portion 712, a bottom portion 714 and a dispenser portion 716. In the illustrated embodiment, the reservoir portion 712 and the bottom portion 714 are the same as, or similar to, the reservoir portion 112 and the bottom portion 114 described above and shown in FIG. 9. However, it is contemplated that in other embodiments, the reservoir portion 712 and the bottom portion 717 can be different from the reservoir portion 112 and bottom portion 114. The dispenser portion 716 includes a first partition 718. In contrast to the substantially planar structure of the first partition 118 shown in FIG. 9, the first partition 718 includes an annular arcuate segment 719 extending from a neck 726. It should be appreciated that the first partition 718 can have any desired structure and shape sufficient for the functions described herein. The neck 726 includes a second circumferential sidewall 728 defining a first internal passage 730.

The first internal passage 730 is configured to receive a projection 182 extending from a base assembly 752. The projection 782 includes an interior passage 766, formed therethrough and a pivotable lid 762. The base assembly 752 is inserted into the second circumferential sidewall 728 with any desired structure, including the non-limiting examples of an interference or threaded fit. In use, the base assembly 752 is removed from the bottom portion 714 and attached to the neck 726 of the dispenser portion 716 as described above. The installed base assembly is represented by reference character 752'. In the installed position, a gap 790 can be formed between the base assembly 752' and the annular arcuate segment 719 forming the first partition 718. It should be appreciated that the size and cross-sectional shape of the gap 790 is a function of the shape of the annular arcuate segment 719 forming the first partition 718.

The principle and mode of operation of the dispenser have been explained and illustrated in certain embodiments. However, it must be understood that the dispenser may be practiced otherwise than as specifically explained and illustrated without departing from its spirit or scope.

What is claimed is:

1. A liquid dispenser comprising:

a reservoir portion having a first circumferential sidewall, a first partition having an opening extending therethrough, and an opposing second partition having no opening extending therethrough, the first circumferential sidewall and first and second partitions defining an interior chamber that is configured to store liquids;

a dispenser portion extending from the first partition and having a neck defined by a second circumferential sidewall, the second circumferential sidewall further defining a first internal passage that is in fluid communication with the interior chamber through the opening extending through the first partition;

a bottom portion extending from the second partition, the bottom portion having a third circumferential sidewall, the third circumferential sidewall and the second partition defining an internal cavity; and a base assembly including a first surface having a pivotable lid and a second surface opposite the first surface, the base assembly configured for a first orientation, wherein the first surface is disposed within the internal cavity of the bottom portion adjacent to the second partition, and a second orientation, wherein the second surface is disposed adjacent to the first partition such that the pivotable lid allows fluid access to the first internal passage of the dispenser portion.

2. The liquid dispenser of claim 1, wherein when the base assembly is in the first, orientation, the dispenser sits on the base assembly when on a horizontal surface.

3. The liquid dispenser of claim 1, wherein when the base assembly is in the second orientation, the dispenser sits on the base assembly when on a horizontal surface.

4. The liquid dispenser of claim 1, wherein the dispenser portion includes a removable pump and cap.

5. The liquid dispenser of claim 4, wherein the second orientation of the base assembly requires removal of the removable pump and cap.

6. The liquid dispenser of claim 1, wherein the base assembly includes an annular recess configured to receive an annular projection extending inwardly from the bottom portion.

7. The liquid dispenser of claim 6, wherein the annular projection extending from the bottom portion is positioned internal to the third circumferential sidewall.

8. The liquid dispenser of claim 6, wherein the recess and the projection form a threaded fit.

9. The liquid dispenser of claim 1, wherein the first circumferential sidewall is formed from a flexible polymeric material.

10. A method of using a liquid dispenser comprising the steps of:

forming a reservoir portion with a first circumferential sidewall, a first partition having an opening extending therethrough, and an opposing second partition having no opening extending therethrough, the first circumferential sidewall and first and second partitions defining an interior chamber that is configured to store liquids;

forming a dispenser portion with a second circumferential sidewall extending from the first partition, the second circumferential sidewall further defining a neck and a first internal passage that is in fluid communication with the interior chamber through the opening extending through the first partition;

extending a bottom portion extending from the second partition, the bottom portion having a third circumferential sidewall, the third circumferential sidewall and the second partition defining an internal cavity; and equipping a base assembly including a first surface with a pivotable lid and a second surface opposite the first surface, the base assembly configured for a first orientation, wherein the first surface is disposed within the internal cavity of the bottom portion adjacent to the second partition, and for a second orientation, wherein the second surface is disposed adjacent to the first partition such that the pivotable lid allows fluid access to the first internal passage of the dispenser portion.

11. The method of claim 10, including the step of seating the dispenser on the base assembly with the base assembly in the first orientation within the internal cavity of the bottom portion.

12. The method of claim 10, including the step of seating the dispenser on the base assembly with the base assembly in the second orientation on the first partition.

13. The method of claim 10, wherein the dispenser portion includes a removable pump and cap.

14. The method of claim 12, including the step of removing the pump and cap prior to seating the base assembly on the first partition.

15. The method of claim 10, wherein the base assembly includes an annular recess configured to receive an annular projection extending inwardly from the bottom portion.

16. The method of claim 15, wherein the annular projection extending from the bottom portion is positioned internal to the third circumferential sidewall.

* * * * *